US008174455B2

(12) United States Patent
Miyoshi et al.

(10) Patent No.: US 8,174,455 B2
(45) Date of Patent: May 8, 2012

(54) ANTENNA ELEMENT WITH IMPROVED RADIATION CHARACTERISTICS

(75) Inventors: Akira Miyoshi, Tokyo (JP); Kozo Shimizu, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 241 days.

(21) Appl. No.: 12/477,379

(22) Filed: Jun. 3, 2009

(65) Prior Publication Data

US 2009/0303143 A1 Dec. 10, 2009

(30) Foreign Application Priority Data

Jun. 4, 2008 (JP) ..... P2008-147182

(51) Int. Cl.
*H01Q 1/38* (2006.01)
*H01Q 21/00* (2006.01)

(52) U.S. Cl. ..... 343/728; 343/700 MS; 343/855

(58) Field of Classification Search ..... 343/700 MS, 343/728, 732, 855, 857, 743, 866
See application file for complete search history.

(56) References Cited

U.S. PATENT DOCUMENTS

| | | | | |
|---|---|---|---|---|
| 6,104,348 | A * | 8/2000 | Karlsson et al. | 343/700 MS |
| 7,042,399 | B2 | 5/2006 | Noro et al. | |
| 7,084,816 | B2 | 8/2006 | Watanabe | |
| 7,126,539 | B2 | 10/2006 | Sampo | |
| 7,129,899 | B2 | 10/2006 | Jecko et al. | |
| 2006/0103576 | A1 * | 5/2006 | Mahmoud et al. | 343/700 MS |

FOREIGN PATENT DOCUMENTS

| | | |
|---|---|---|
| EP | 1 758 204 | 7/2006 |
| JP | 2006-261941 | 9/2006 |
| JP | 2008-66979 | 3/2008 |
| WO | WO 2008/054803 | 5/2008 |

OTHER PUBLICATIONS

Alsiety, M.K., et al., "A Study of Ground-Plane-Level and Vehicle-Level Radiation Patterns of GPS Antenna in Telematics Applications.", IEEE Antennas and Wireless Propagation Letters, vol. 6, 2007, pp. 130-133.

Kokotoff, D.M., et al., "Annular ring coupled circular patch with enhanced performance.", Antennas and Propagation, IEEE Transaction, 45, pp. 2000-2001.

(Continued)

*Primary Examiner* — Jacob Y Choi
*Assistant Examiner* — Amal Patel
(74) *Attorney, Agent, or Firm* — Whitham Curtis Christofferson & Cook, PC

(57) ABSTRACT

An antenna element is disclosed. A substrate is made of dielectric material and has a first face. A first antenna element is made of conductive material and is provided on the first face. A first power feeding portion is made of conductive material and is disposed on the first antenna element. A second antenna element is made of conductive material, is provided on the first face, and forms a loop surrounding the first antenna element with a gap. A second power feeding portion is made of conductive material. The second power feeding portion is extended from the second antenna element toward the first antenna element and is arranged to form an electromagnetic coupling with the first antenna element. A perturbation element is made of conductive material and is extended from the second antenna element. A length of loop is twice a circumferential length of the first antenna element.

11 Claims, 6 Drawing Sheets

OTHER PUBLICATIONS

Waterhouse, P.B., et al., "Printed antenna suitable for mobil communication handsets.", Electronics Letters, 33, Oct. 23, 1997,pp. 1831-1832.

Kokotoff, D.M., et al., "An Annular Ring Coupled to a Shorted Patch.", Antennas and Propagation, IEEE Transactions, 45, May 1997.

Ammann, M.N., et al., "Miniaturized Annular Ring Loaded Patch Antennas." Antennas and Propagation Soceity International Symposium, Jun. 9-15, 2007, pp. 912-915.

German Office action dated Aug. 8, 2011 with English translation.

* cited by examiner

Fig. 1
Prior Art
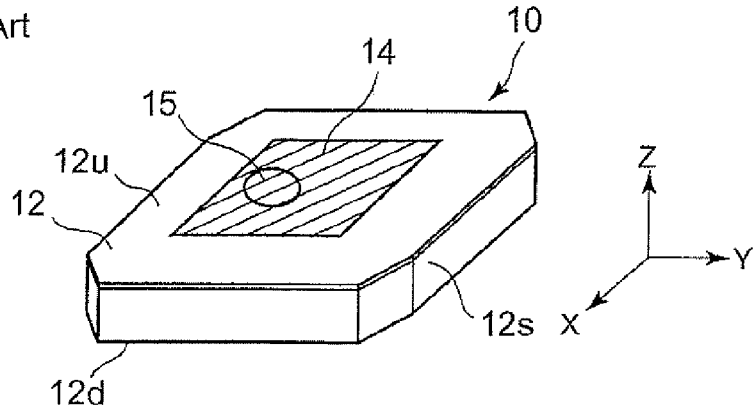
Fig. 2C
Prior Art
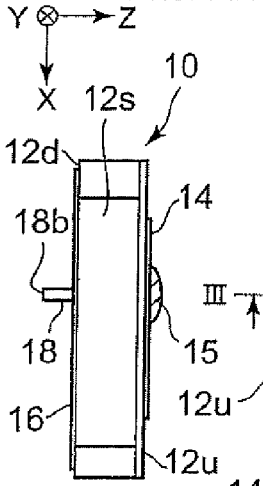
Fig. 2A
Prior Art
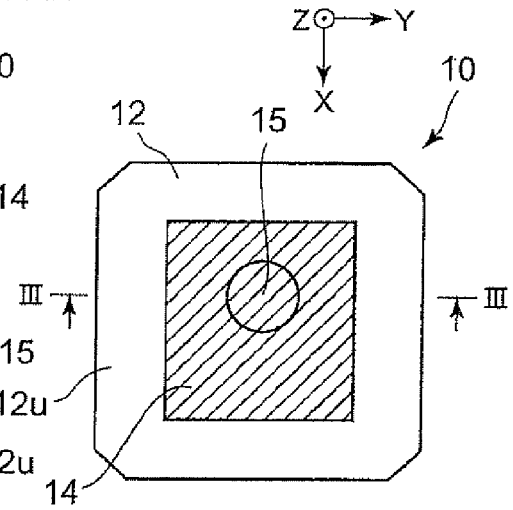
Fig. 2D
Prior Art
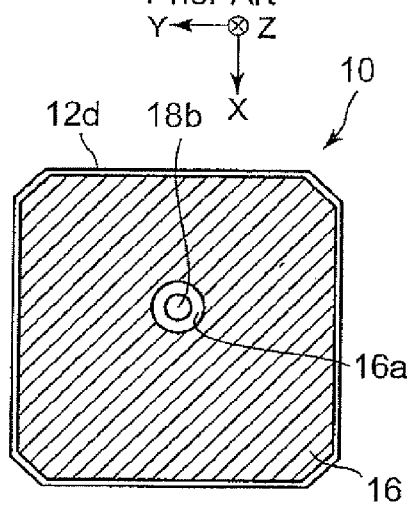
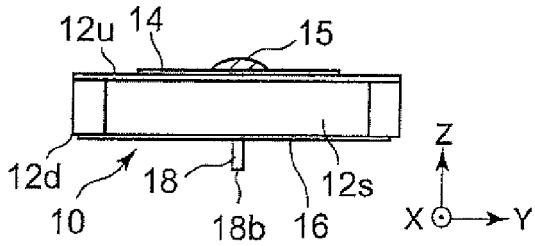
Fig. 2B
Prior Art

ANTENNA ELEMENT WITH IMPROVED RADIATION CHARACTERISTICS

BACKGROUND

The present invention relates to an antenna element and, in particular, relates to an antenna element suitable for receiving a GPS signal from a GPS satellite.

As is well known in this technical field, various kinds of antennas are mounted on a vehicle. There is an antenna for GPS (Global Positioning System) as one of such antennas.

The GPS is a positioning system using a satellite. The GPS is configured to receive radio waves (GPS signals) from four or more satellites among twenty four satellites (hereinafter referred to as GPS satellites) orbiting the earth. The GPS is capable to calculate the position and altitude (on a map) of a movable body with a high accuracy based on the theory of the triangular survey using positional relations and time differences between the movable body and the GPS satellites obtained by the received radio waves (GPS signals).

In recent years, the GPS is utilized and widely spread. For example, the GPS is used for a vehicle navigation system for detecting the position of a vehicle in a running state. The vehicle navigation device includes a GPS antenna for receiving the GPS signals, a processor for processing the GPS signals received by the GPS antenna to thereby detect the current position of the vehicle, and a display for displaying the position detected by the processor on a map. A flat antenna such as a patch antenna is used as the GPS antenna.

The patch antenna disclosed in Japanese Patent Publication No. 2008-66979A includes a dielectric substrate, a patch antenna electrode, a ground electrode and a feeding pin. The dielectric substrate has a top face and a bottom face opposing each other. The dielectric substrate is provided with a through hole penetrating from the top face to the bottom face at a feeding point. The patch antenna electrode is formed by a conductive material and provided on the top face of the dielectric substrate. The ground electrode is formed by a conductive material and provided on the bottom face of the dielectric substrate. The ground electrode has an opening which is substantially concentric with the through hole and the diameter of which is larger than the diameter of the through hole. The feeding pin has a first end and a second end. The first end of the feeding pin is coupled to the patch antenna electrode at the feeding point. The second end of the feeding pin is led to the bottom face side of the dielectric substrate through the opening. The feeding point is provided at a position away from the center of the patch antenna electrode.

A portable navigation device is known. The GPS antenna is required to be attached in the portable navigation device. There are two ways for attaching the GPS antenna to the portable navigation device. The first way is that the GPS antenna is attached to the exterior of the portable navigation device. The second way is that the GPS antenna is provided within the portable navigation device. There are two methods the correspond to the first way. The first method is that an antenna housing accommodating the GPS antenna is provided on an upper portion of the portable navigation device. The second method is that the antenna housing is attached at an arbitrary angle. On the other hand, in the second way, the GPS antenna is disposed on a circuit board accommodated within the portable navigation device.

An antenna device disclosed in Japanese Patent Publication No. 2006-261941 A can realize at least one of a directionality control and a multi-frequency adaptation. The antenna device includes a base plate, a dielectric member formed on one major face of the base plate, a substantially rectangular feeding element formed on a top face of the dielectric member which is opposite to a face of the dielectric member opposing the base plate, a substantially rectangular parasitic element disposed symmetrically to the feeding element along an electric field face and a magnetic field face, and a switch formed at least at one of regions near four apexes of the parasitic element and short-circuiting the feeding element and the base plate.

With reference to FIGS. 1 through 5, a conventional patch antenna 10 will be explained. In FIGS. 1 to 3, the forward and backward direction (depth direction) is represented by an X-direction, the left and right direction (width direction) is represented by a Y-direction, and the elevational direction (height direction, thickness direction) is represented by a Z-direction.

The patch element 10 is constituted by a dielectric substrate 12 having a substantially rectangular parallelepiped shape, a patch antenna electrode 14, a ground electrode 16 and a feeding pin 18 having a rivet shape.

The dielectric substrate 12 is formed by ceramic material having a high permittivity (for example, a relative permittivity $\in_r$ is 20) such as barium titanate. The dielectric substrate 12 has a top face 12*u* and a bottom face 12*d* opposing to each other in the Z-direction, and side faces 12*s*. The corners of the side faces 12*s* of the dielectric substrate 12 are chamfered. The dielectric substrate 12 is provided with a through hole 12*a* which penetrates from the top face 12*u* to the bottom face 12*d*.

In the example shown in the drawings, the dielectric substrate 12 is arranged to have a size that the length in the X-direction is 25 mm, a length in the Y-direction is 25 mm, and a length in the Z-direction is 4 mm.

The patch antenna electrode 14 is formed by conductive material and provided at the center portion of the top face 12*u* of the dielectric substrate 12. The patch antenna electrode 14 has a rectangular shape and a size wherein a length in the X-direction is 12.3 mm and a length in the Y-direction is 12.5 mm. The patch antenna electrode 14 is formed by a silver pattern printing, for example.

As shown in FIG. 2D, the ground electrode 16 is formed by conductive material and provided at the bottom face 12*d* of the dielectric substrate 12. The ground electrode 16 has an opening 16*a* which is substantially concentric with the through hole 12*a* and the diameter of which is larger than the diameter of the through hole 12*a*.

A feeding point 15 is provided at the position shifted in the X-direction and the Y-direction from the center of the patch antenna electrode 14. An upper end portion 18*a* of the feeding pin 18 is coupled to the feeding point 15. A lower end portion 18*b* of the pin 18 is lead to a lower side of the ground electrode 16 through the through hole 12*a* and the ground opening portion 16*a*.

A solder is used as the feeding point 15. Thus, the feeding point 15 has a convex shape protruded from a major face of the patch antenna electrode 14.

The feeding pin 18 shown in the drawing includes a rivet pin having a head 181 provided at the upper end portion 18*a* and a rod-shaped body 182 extending to a lower end portion 18*b* of the feeding pin 18 from the upper end portion 18*a*. The head 181 of the feeding pin 18 is joined to the patch antenna electrode 14 by soldering in a state that the head 181 of the feeding pin 18 protrudes from the major face of the patch antenna electrode 14.

The antenna element 10 is incorporated or accommodated in a portable navigation device (PND) 80 as shown in FIG. 4, when the antenna element 10 can be used as the GPS antenna.

The portable navigation device (PND) 80 shown in FIG. 4 includes a casing 82 and a display 84 provided on the front face of the casing 82. In this case, the antenna element 10 is mounted on a circuit board (described later) accommodated within the portable navigation device 80.

As shown in FIG. 5, such a portable navigation device 80 can also be used as a vehicle navigation device by disposing vertically on the dashboard within a vehicle. In this case, the circuit board 86 of the portable navigation device 80 is also disposed in a vertical attitude. Thus, since the antenna element 10 used as the GPS antenna is also mounted on the major face of the circuit board 86, the normal line of the top face 12*u* of the dielectric substrate 12 is directed to the horizontal direction with respect to the GPS satellites 70 existing in the zenith direction, that is, the front direction of the vehicle, for example.

As shown in FIG. 5, in the conventional patch antenna element 10, the main beam is always directed in the vertical direction (normal direction) A with respect to the top face 12*u* of the dielectric substrate 12. Thus, in the conventional patch antenna 10, it becomes difficult to efficiently receive the GPS signals from the satellites 70.

The Japanese Patent Publication No. 2006-261941 A merely discloses an antenna device which can realize at least one of directionality control and the multi-frequency adaptation and does not disclose or suggest disposing the antenna device within the portable navigation device or a problem caused in this case.

SUMMARY

It is therefore one advantageous aspect of the present invention to provide an antenna element which can efficiently receive satellite waves such as GPS signals even when the normal line of a patch antenna electrode is directed to the front direction.

According to one aspect of the invention, there is provided an antenna element comprising:

a substrate made of dielectric material and having a first face;

a first antenna element made of conductive material and provided on the first face;

a first power feeding portion made of conductive material and disposed on the first antenna element;

a second antenna element made of conductive material, provided on the first face, and forming a loop surrounding the first antenna element with a gap;

a second power feeding portion made of conductive material, the second power feeding portion extended from the second antenna element toward the first antenna element and arranged to form an electromagnetic coupling with the first antenna element; and a perturbation element made of conductive material and extended from the second antenna element, wherein a length of loop is twice a circumferential length of the first antenna element.

The antenna element may be configured such that: the substrate has a rectangular parallelepiped shape.

The antenna element may be configured such that: the substrate is made of ceramic.

The antenna element may be configured such that: the antenna element further comprises a ground electrode made of conductive material and provided on a second face of the substrate opposite to the first face, wherein the first antenna element, the second antenna element, the second power feeding portion, the perturbation element, and the ground electrode are formed by printed patterns made of silver.

The antenna element may be configured such that: the antenna element further comprises: a ground electrode made of conductive material and provided on a second face of the substrate opposite to the first face; and a power feeding pin having an end portion electrically connected to the first antenna element, wherein the substrate is formed with a through hole connecting the first face and the second face and having a first diameter, wherein the power feeding pin extends through the through hole, and wherein the ground electrode is formed with a hole which is concentric with the through hole and has a second diameter larger than the first diameter.

The antenna element may be configured such that: the first antenna element has a first side, a second side opposing the first side, a third side, and a fourth side opposing the third side; the first side and the second side have a first length, and the third side and the fourth side have a second length which is shorter than the first length; the loop has four straight portions lengths of which are identical with each other; the first power feeding portion is disposed at a position that is closer to the first side than the second side; the second power feeding portion is extended from one of the straight portions opposing the second side.

The antenna element may be configured such that: the perturbation element is extended from one of the straight portions opposing the second side.

The antenna element may be configured such that: the second power feeding portion has a first part which is extended from the one of the straight portions opposing the second side toward the second side and a second part extended from the first part in a direction parallel to the second side.

The antenna element may be configured such that: the position of the first power feeding portion is closer to the third side is than the fourth side, and the perturbation element is closer to one of the straight potions opposing the third side than the second power feeding portion.

The antenna element may be configured such that: the antenna element is configured to receive a GPS signal from GPS satellites.

A portable navigation device housing the antenna element may be configured such that: the portable navigation device comprises a circuit board, on which the antenna element is mounted on the circuit board.

BRIEF DESCRIPTION OF THE DRAWINGS

FIG. 1 is a perspective view showing a conventional patch antenna.

FIG. 2A is a plan view of the conventional patch antenna.

FIG. 2B is a front view of the conventional patch antenna.

FIG. 2C is a left side view of the conventional patch antenna.

FIG. 2D is a bottom view of the conventional patch antenna.

DETAILED DESCRIPTION OF EXEMPLIFIED EMBODIMENTS

Figure 3:
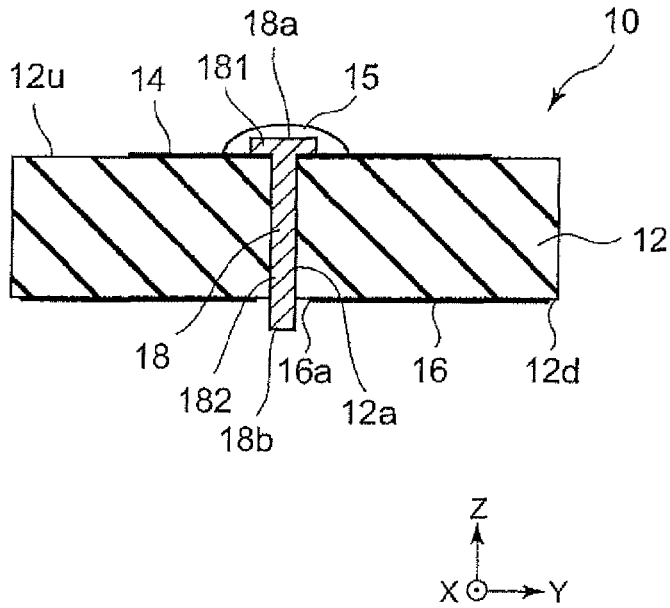
Fig. 3 Prior Art
FIG. 3 is a sectional view taken along a line III-III in FIG. 2A.
Figure 4:
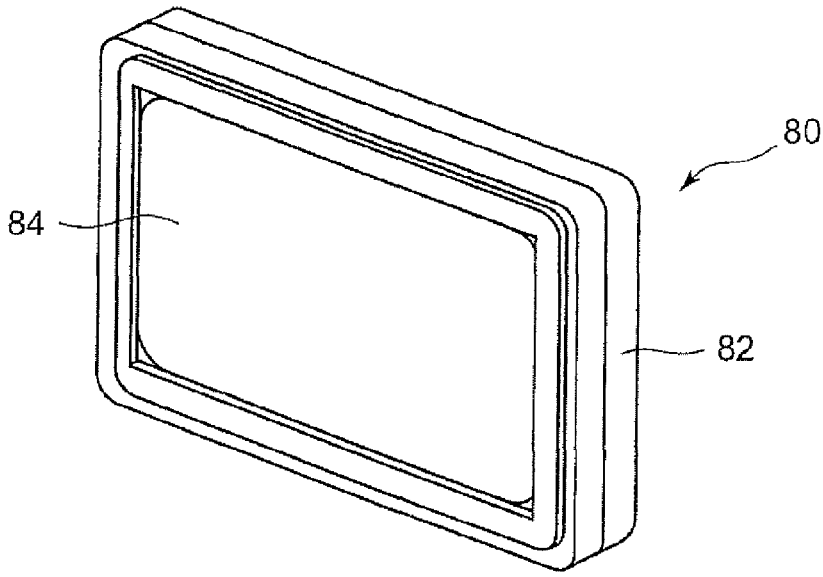
Fig. 4 Prior Art
FIG. 4 is a perspective view showing a portable navigation device incorporating the conventional patch antenna.
Figure 5:
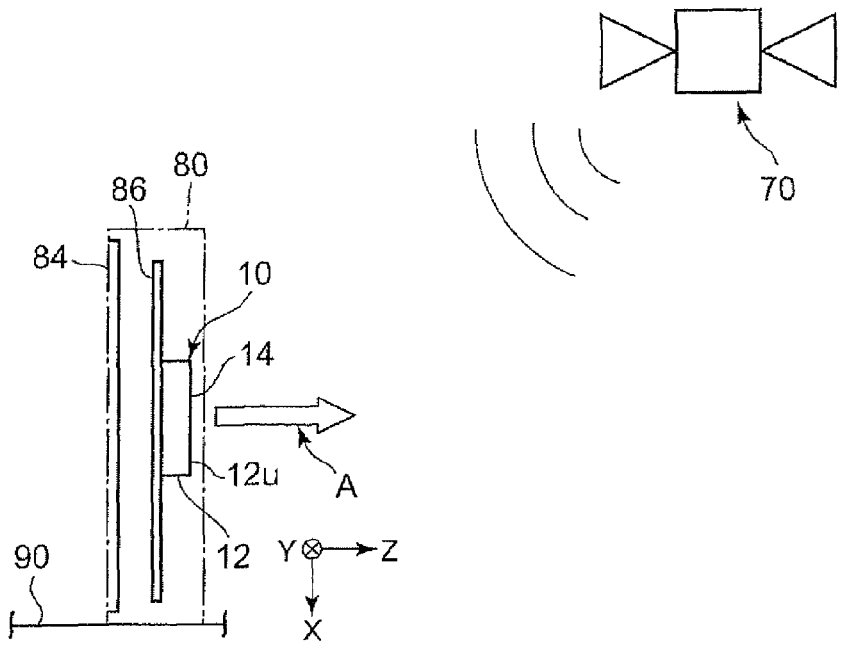
Fig. 5 Prior Art
FIG. 5 is a diagram showing a state that the conventional portable navigation device shown in FIG. 4 is vertically disposed on a dashboard of a vehicle.

Exemplified embodiments of the invention are described below in detail with reference to the accompanying drawings.

An antenna element 10A according to one embodiment of the present invention will be explained with reference to FIGS. 6 and 7. The antenna element 10A has the same configuration as the conventional antenna 10 except that the dielectric substrate is modified as explained later and that a loop antenna electrode 22, a feeding line 24 and a perturbation element 26 are further provided. Thus, the dielectric substrate is denoted by a reference numeral 12A. Components similar to those in the antenna apparatus 10 will be denoted by the same reference numerals and repetitive explanations for those will be omitted.

Figure 6:
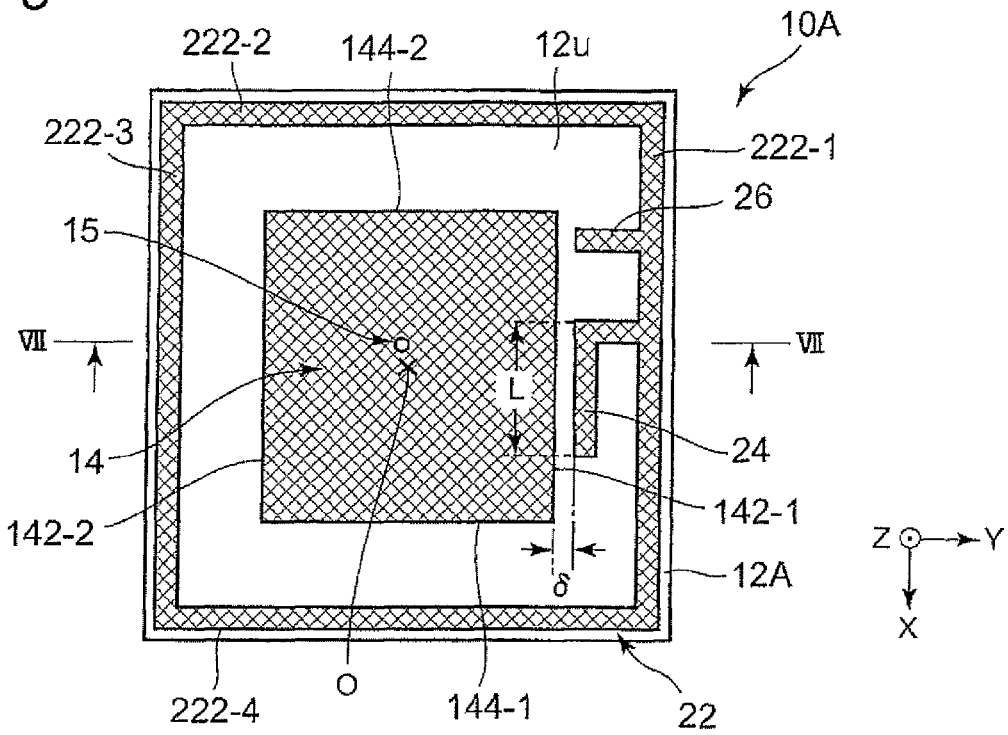
FIG. 6 is a plan view showing an antenna element according one embodiment of the present invention.
Figure 7:
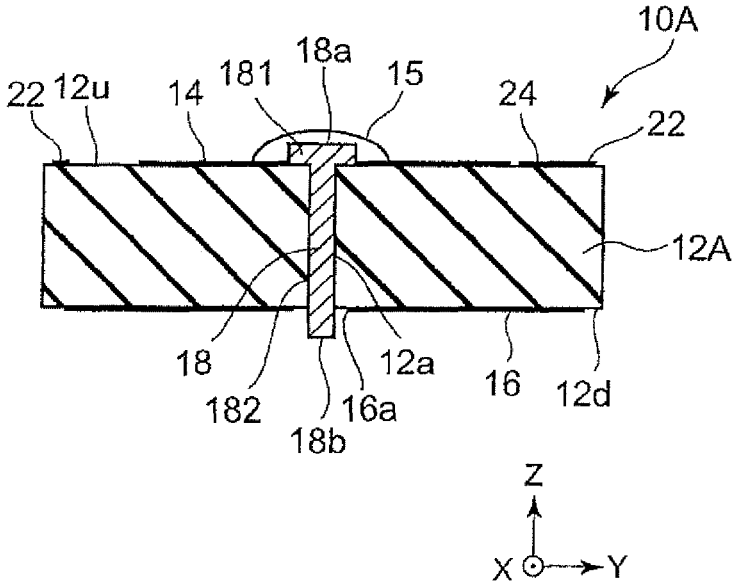
FIG. 7 is a sectional view taken along a line VII-VII in FIG. 6.

In FIGS. 6 and 7, the forward and backward direction (depth direction) is represented by an X-direction, the left and right direction (width direction) is represented by a Y-direction, and the elevational direction (height direction, thickness direction) is represented by a Z-direction.

The dielectric substrate 12A shown in the drawings is not chamfered at the corners of the side face 12*s*. In the drawings, the dielectric substrate 12A is formed by ceramic material a relative permittivity $\in_r$ of which is 38. The dielectric substrate 12A is arranged to have a size that a length in the X-direction is 25 mm, a length in the Y-direction is 25 mm, and a length in the Z-direction is 4 mm.

The loop antenna electrode 22, the feeding line 24 and the perturbation element 26 and the patch antenna electrode 14 are formed on the top face 12*u* of the dielectric substrate 12A.

The patch antenna electrode 14 is formed by conductive material and provided at the center portion of the top face 12*u* of the dielectric substrate 12. An outer circumferential length of the patch antenna electrode 14 is set to be 1λ when a reception wavelength of the antenna element 10A is λ. The patch antenna electrode 14 shown in the drawings is formed by the silver pattern printing. The patch antenna electrode 14 has a rectangle shape which has a pair of long sides 142-1, 142-2 opposing each other along the X-direction and a pair of short sides 141-1, 141-2 opposing each other along the Y-direction.

The feeding point 15 is provided at the position away from the center of the patch antenna electrode 14. In the drawings, the feeding point 15 is provided at the position closer to the long side 142-2 in the Y-direction and the short side 144-2 in the X-direction than the long side 142-1 and the short side 144-1 respectively. Thereby, a patch antenna portion including the patch antenna electrode 14 can receive a right-handed circularly polarized wave.

The loop antenna electrode 22 is formed by dielectric material and provided at the outer circumferential portion of the top face 12*u* of the dielectric substrate 12. That is, the loop antenna electrode 22 is disposed so as to surround the patch antenna electrode 14 with a gap on the top face 12*u* of the dielectric substrate 12. The loop length of the loop antenna electrode 22 is set to be 2λ. The loop antenna electrode 22 is has a square frame shape having four conductive line segments 222-1, 222-2, 222-3 and 222-4 of the same length. The loop antenna electrode 22 shown in the drawings is also formed by the silver pattern printing.

The feeding line 24 is formed by a conductive material and extends toward the patch antenna electrode 14 from the loop antenna electrode 22. The feeding line 24 is electromagnetically coupled with the patch antenna electrode 14. That is, a gap δ is provided between the patch antenna electrode 14 and the feeding line 24, whereby the feeding line 24 feeds power to the loop antenna electrode 22 through the electromagnetic coupling. Since power is supplied to the loop antenna electrode 22 through the electromagnetic coupling, the impedance matching can be realized easily. The impedance can be adjusted by changing a size of the gap δ. Further, the frequency characteristics of the antenna element 10A can be changed by changing a coupling length L between the feeding line 24 and the patch antenna electrode 14.

As shown in FIG. 6, the feeding line 24 extends from a conductive line segment 222-1 which opposes the long side 142-1 which is opposite to the long side 142-2 to which the feeding point 15 is closer than the long side 142-1.

A perturbation element 26 is formed by a conductive material and provided at the loop antenna electrode 22. To be concrete, the perturbation element 26 is provided at the particular conductive line segment 222-1 of the loop antenna electrode 22. In other words, the perturbation element 26 is provided on the conductive line segment 222-1 at a position where it is closer to the short side 144-2 than the short side 144-1. Since the perturbation element 26 is provided at this position, a loop antenna portion including the loop antenna electrode 22 can receive a right-handed circularly polarized wave.

Each of the feeding line 24 and the perturbation element 26 is formed by the silver pattern printing.

In the aforesaid configuration of the antenna element 10A, although the outer circumferential length of the patch antenna electrode 14 is set to be 1λ and the loop length of the loop antenna electrode 22 is set to be 2λ, the invention is not limited to the aforesaid outer circumferential lengths (loop lengths) of the patch antenna electrode 14 and the loop antenna electrode 22 so long as the loop length of the loop antenna electrode is two times as large as the outer circumferential length of the patch antenna electrode.

The antenna element 10A configured the above-mentioned manner has a radiation pattern composed by the radiation pattern of the patch antenna portion including the patch antenna electrode 14 and the radiation pattern of the loop antenna portion including the loop antenna electrode 22. As a result, the main beam of the antenna element 10A can be tilted in a particular direction (the rear direction of the X-direction in FIG. 6). Thus, such an antenna element 10A is also called "a tilt beam antenna element".

Further, since the patch antenna electrode 14, the loop antenna electrode 22, the feeding line 24 and the perturbation element 26 are formed on the top face 12*u* of the dielectric substrate 12A, the loop antenna electrode 22 is also supplied with power by supplying power to the patch antenna electrode 14 at the feeding point 15. Thus, only one feeding point 15 is required.

Figure 8:
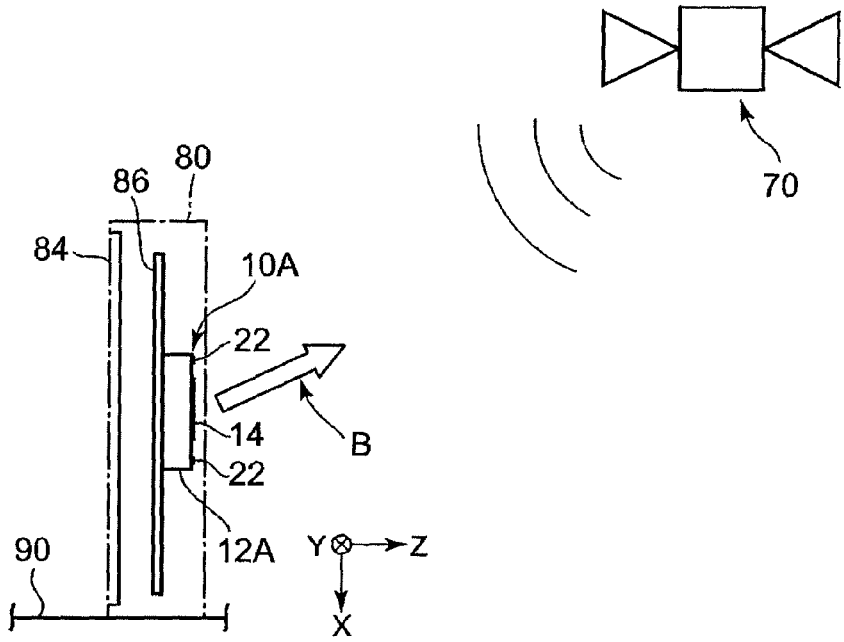
FIG. 8 is a diagram showing a state that a portable navigation device incorporating the antenna element of the invention is vertically disposed on a dashboard of a vehicle.

As shown in FIG. 8, the portable navigation device 80 can also be used as a vehicle navigation device when being disposed vertically on the dashboard within a vehicle. In this case, the circuit board 86 of the portable navigation device 80 is also disposed vertically. Thus, since the antenna element 10A used as the GPS antenna is also disposed on the one major face of the circuit board 86, the normal line of the top face 12*u* of the dielectric substrate 12A is directed to the front direction of the vehicle.

However, as described above, the main beam of the antenna element 10A is tilted in a particular direction B as shown by an arrow B in FIG. 8. In other words, as shown in FIG. 8, the antenna element 10A radiates the main beam in the direction B upward in the vertical direction (normal line direction) of the top face 12*u* of the dielectric substrate 12. Thus, the antenna 10A can efficiently receive the GPS signals from the satellites 70. That is, the reception sensitivity of the portable navigation device 80 can be enhanced.

Figure 9:
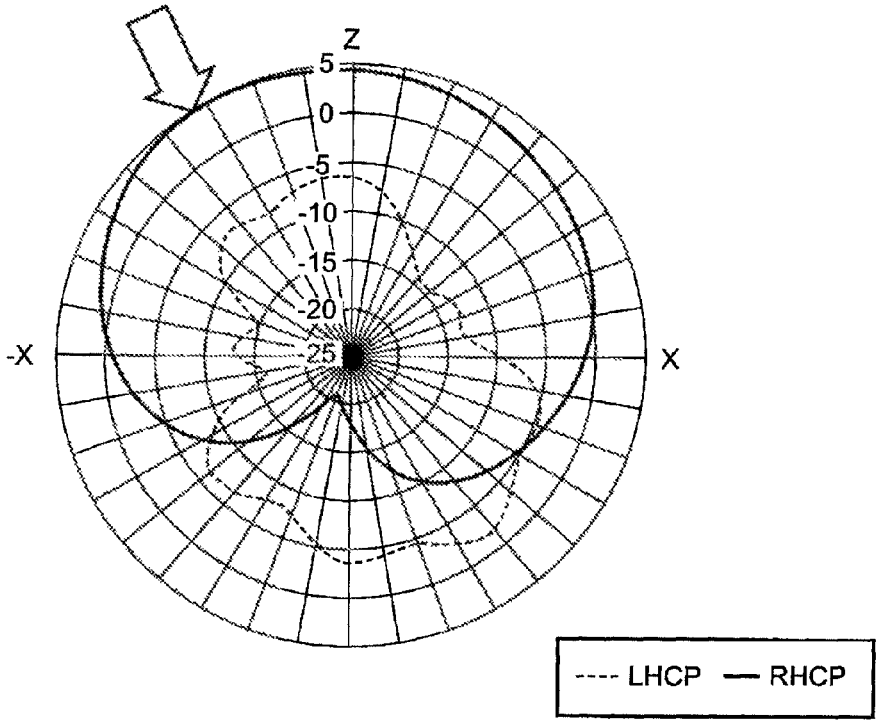
FIG. 9 is a diagram showing the radiation characteristics (vertical radiation pattern) of the antenna element of the invention.

In FIG. 9, RHCP represents a radiation pattern of a right-handed circularly polarized wave and LHCP represents a radiation pattern of a left-handed circularly polarized wave FIG. 9 shows that the main beam of the right-handed circularly polarized wave is inclined to the backward direction of the X-direction (the upward direction in the example of FIG. 8) by a tilt angle of about 25 degrees with respect to (with respect to the forward direction in FIG. 8) the Z-direction (the normal line direction of the top face 12*u* of the dielectric substrate 12).

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The material of the dielectric substrate is not limited to ceramic material and may be resin material. Further, although the patch element according to the present invention is suitable for receiving the GPS signals, the antenna element according to the invention may be utilized as an antenna element for receiving various kinds of radio waves as signals. Further, although the antenna element 10A shown in FIG. 6 is an antenna element for receiving the right-handed circularly polarized wave, the antenna element may be for receiving the left-handed circularly polarized wave. The patch antenna electrode 14 may have polygonal shape other than the rectangular parallelepiped shape as long as the polygonal shape has two pairs of sides opposing each other, for example, a hexagonal shape or an octagonal shape.

The disclosure of Japanese Patent Application No. 2008-147182 filed Jun. 4, 2008 including specification, drawings and claims is incorporated herein by reference in it is entirety.

What is claimed is:

1. An antenna element comprising:

a substrate made of dielectric material and having a first face;

a first antenna element made of conductive material and provided on the first face, and configured to receive a circularly polarized wave in a radiation direction;

a first power feeding portion made of conductive material and disposed on the first antenna element at a position displaced from a center of the first antenna element;

a second antenna element made of conductive material, provided on the first face, and forming a loop surrounding the first antenna element with a gap between the first antenna element and the second antenna element;

a second power feeding portion made of conductive material, the second power feeding portion extended from a second antenna element toward the first antenna element and arranged along an edge of the first antenna element so as to form an electromagnetic coupling with the first antenna element to feed power to the second antenna element; and a perturbation element made of conductive material and extended from the second antenna element so that the second antenna element receives a circularly polarized wave in the radiation direction, wherein a length of the loop is twice a circumference length of the first antenna element, and wherein a radiation pattern of the antenna element is composed of a radiation pattern of the first antenna element and a radiation pattern of the second antenna element such that a main beam of the antenna element can be tilted at an angle less than 90 degrees with respect to a line that is perpendicular to the first face.

2. The antenna element set forth in claim 1, wherein the substrate has a rectangular parallelepiped shape.

3. The antenna element set forth in claim 1, wherein the substrate is made of ceramic.

4. The antenna element set forth in claim 1, further comprising a ground electrode made of conductive material and provided on a second face of the substrate opposite to the first face, wherein the first antenna element, the second antenna element, the second power feeding portion, the perturbation element, and the ground electrode are formed by printed patterns made of silver.

5. The antenna element set forth in claim 1, further comprising:

a ground electrode made of conductive material and provided on a second face of the substrate opposite to the first face; and a power feeding pin having an end portion of the power feeding pin electrically connected to the first antenna element, wherein the substrate is formed with a through hole connecting the first face and the second face and having a first diameter, wherein the power feeding pin extends through the through hole, and wherein the ground electrode is formed with a hole which is concentric with the through hole and has a second diameter being than the first diameter.

6. The antenna element set forth in claim 1, wherein:

the first antenna element has a first side, a second side opposing the first side, a third side, and a fourth side opposing the third side;

the first side and the second side have a first length, and the third side and the fourth side have a second length which is shorter than the first length;

the loop has four straight portions lengths of which are identical with each other;

the first power feeding portion is disposed at a position that is closer to the first side than the second side;

the second power feeding portion is extended from one of the straight portions opposing the second side.

7. The antenna element set forth in claim 6, wherein the perturbation element is extended from the one of the straight portions opposing the second side.

8. The antenna element set forth in claim 6, wherein the second power feeding portion has a first part which is extended from the one of the straight portions opposing the second side toward the second side and a second part extended from the first part in a direction parallel to the second side.

9. The antenna element set forth in claim 6, wherein the position of the first power feeding portion is that is closer to the third side is than the fourth side, and the perturbation element is closer to one of the straight potions opposing the third side than the second power feeding portion.

10. The antenna element set forth in claim 1, wherein the antenna element is configured to receive a GPS signal from GPS satellites.

11. A portable navigation device, comprising a circuit board, on which antenna element is set forth in claim 10 mounted on the circuit board.

* * * * *